United States Patent [19]

Kuwahara et al.

[11] Patent Number: 4,794,775

[45] Date of Patent: Jan. 3, 1989

[54] METHOD OF PRODUCING A HEAT TRANSFER TUBE FOR SINGLE-PHASE FLOW

[75] Inventors: Heikichi Kuwahara, Ibaraki; Kenji Takahashi, Abiko; Takehiko Yanagida, Tsuchiura; Wataru Nakayama, Kashiwa; Shigeo Sugimoto, Ibaraki; Kiyoshi Oizumi, Tsuchiura, all of Japan

[73] Assignees: Hitachi, Ltd.; Hitachi Cable, Ltd., Tokyo, Japan

[21] Appl. No.: 945,564

[22] Filed: Dec. 23, 1986

Related U.S. Application Data

[62] Division of Ser. No. 746,798, Jun. 20, 1985, Pat. No. 4,690,211.

[30] Foreign Application Priority Data

Jun. 20, 1984 [JP] Japan ..... 59-125224

[51] Int. Cl.[4] ..... B21D 53/06

[52] U.S. Cl. ..... 72/78; 29/157.3 H

[58] Field of Search ..... 72/77, 78, 95, 98, 100, 72/191, 194; 29/157.3 AH, 157.3 A, 157.3 H

[56] References Cited

U.S. PATENT DOCUMENTS 3,387,477 6/1968 Shupper ..... 72/78
4,451,966 6/1984 Lee ..... 29/157.4

FOREIGN PATENT DOCUMENTS 0102407 3/1984 European Pat. Off. .... 29/157.3 AH
209432 12/1983 Japan ..... 29/157.3 H

*Primary Examiner*—Lowell A. Larson
*Attorney, Agent, or Firm*—Antonelli, Terry & Wands

[57] ABSTRACT

A method for producing a heat transfer tube for single-phase flow having rows of discontinuous projections formed on the inner surface thereof along one or more spiral curves. Each projection has a circular, elliptic or a similar cross-section constituted by smooth curves at any desired height including the bottom thereof. The cross-sectional area of the projection progressively decreases towards the top of the projection.

4 Claims, 14 Drawing Sheets

METHOD OF PRODUCING A HEAT TRANSFER TUBE FOR SINGLE-PHASE FLOW

This is a division of application Ser. No. 746,798, filed June 20, 1985, now U.S. Pat. No. 4,690,211, granted Sept. 1, 1987.

BACKGROUND OF THE INVENTION

The present invention relates to a heat transfer tube for use in heat exchangers of, for example, air conditioners, refrigerators and so forth, and also relates to a method of producing the heat transfer tube. The heat transfer tube of the invention is suited particularly to heat transfer between a single phase flow in the tube and a fluid flowing outside the tube.

Heat exchangers of air conditioners and refrigerators incorporate heat transfer tubes. Various types of heat transfer tubes have been proposed, with some of these heat transfer tubes have smooth inner surfaces, while other heat transfer tubes have two- or three-dimensionally machined surfaces. For instance, U.S. Pat. No. 3,768,291 shows a heat transfer tube having two-dimensional ribs formed on the inner surface thereof and U.S. Pat. No. 3,830,087 discloses a heat transfer tube in which a rolling plug is driven into the tube blank so as to effect a grooving thereby forming primary ribs and then an additional machining is conducted to form secondary grooves, thus providing the tube inner surface with three-dimensional projections.

The heat transfer tubes having two- or three-dimensionally machined inner surfaces encounter the following problems when used for a single phase flow of a fluid. Namely, since the edges of the projections on the tube inner surface are not rounded by are sharp, exfoliation eddy current are formed in the fluid when the fluid turns around the sharp corners or edges, so that a large pressure drop is caused between the inlet and outlet ends of the heat transfer tube, requiring a greater power for driving the fluid through the tube. In addition, the fluid tends to stagnate on the rib surfaces perpendicular to the streamline so that the kinetic energy possessed by the fluid is changed into collision pressure to cause a wear of the ribs during a long uses. As a result, the heights and shapes of the ribs are gradually changed from the optimum design heights and shapes, resulting in a degradation of the heat transfer performance.

In addition, the method for forming ribs by rolling plug essentially requires a troublesome work including the primary grooving and secondary grooving, resulting in a raised production cost of the heat transfer tube.

Accordingly, an object of the invention is to provide a heat transfer tube for single phase flow, having a high heat transfer rate and provided with a highly durable construction of the heat transfer surface, as well as a method which permits the production of such a heat transfer tube at a low cost.

To this end, according to the invention, there is provided a heat transfer tube having projections formed on the inner surface thereof, wherein each projection having a cross-section constituted by smooth curves such as a circle or an ellipse at its bottom and at its any desired height, and wherein the ribs are regularly arranged along spiral curves.

DETAILED DESCRIPTION OF THE PREFERRED EMBODIMENT

Figure 1:
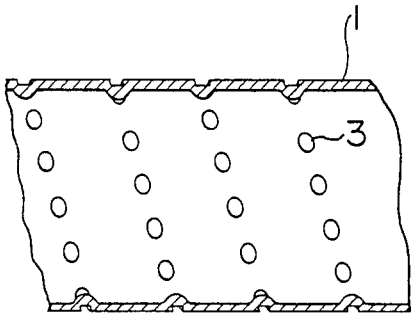
FIG. 1 is a vertical sectional view of a heat transfer tube constructed in accordance with an embodiment of the invention.
Figure 2:
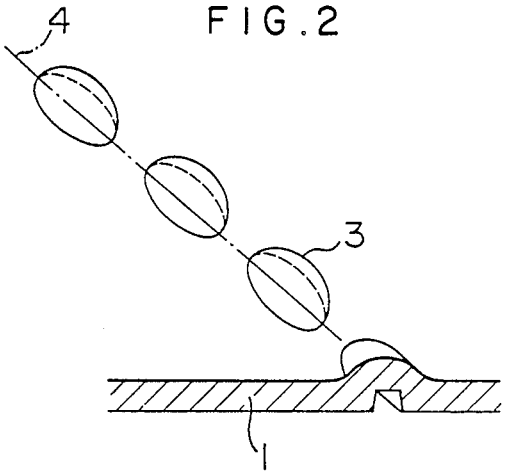
FIG. 2 is an enlarged perspective view of an essential part of a heat transfer tube in accordance with the invention.
Figure 3A:
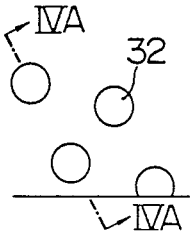
FIGS. 3A, 3B, 3C and 3D are plan views of different embodiments of the present invention.
Figure 3B:
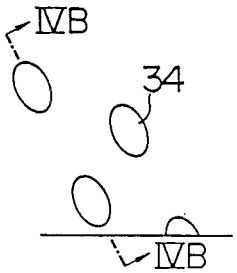
Figure 3C:
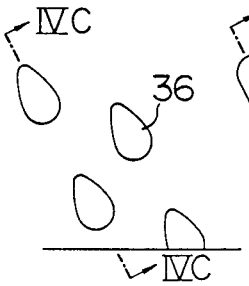
Figure 3D:
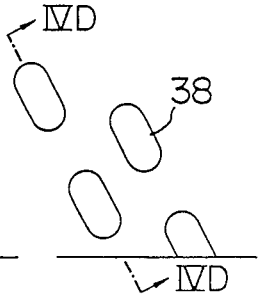
Figure 4A:
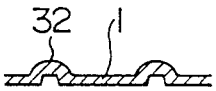
FIGS. 4A, 4B, 4C and 4D are cross-sectional views of the embodiments shown in FIGS. 3A, 3B, 3C and 3D, respectively.
Figure 4B:
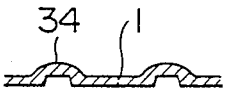
Figure 4C:
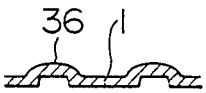
Figure 4D:
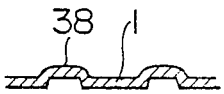

Referring now to the drawings wherein like reference numerals are used throughout the various views to designate like parts and, more particularly to FIGS. 1 and 2, according to these figures a heat transfer tube of the invention has an inner surface 1 on which are formed projections 3 along a spiral curve 4. The projection, when viewed in plan, can have a circular form 32 as shown in FIG. 3A, an eliptic form 34 as shown in FIG. 3B, an asymmetric form 36 as shown in FIG. 3C or an elongated circular form 38 as shown in FIG. 3D. The projection has an almost constant cross-sectional shape over its entire height from the bottom to the top, although the cross-sectional area is progressively decreased from the bottom towards the top thereof. The vertical section of the projection also is constituted by smooth curves as shown in FIGS. 4A, 4B, 4C and 4D. The plan shapes as shown in FIGS. 3A to 3D are only illustrative and the projection can have any desired forms resembling those shown in these Figures.

A method in accordance with the invention for producing this heat transfer tube will be explained hereinunder.

Figure 5:
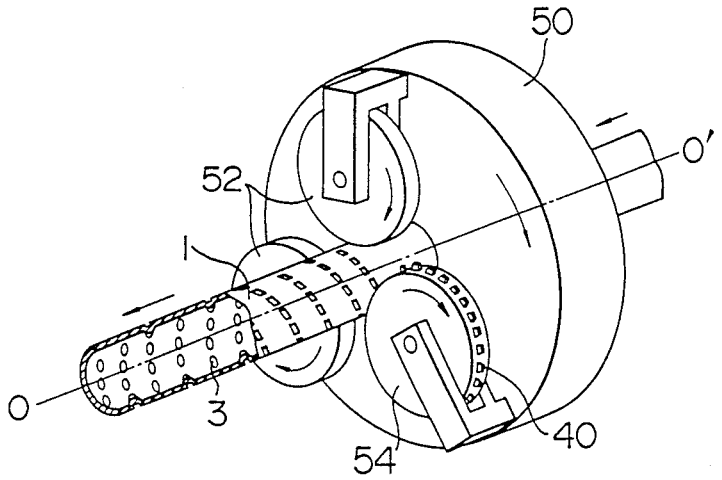
FIGS. 5 and 5A are illustrations of an embodiment of the production method in accordance with the invention.

FIG. 5 showing an example of the production method which makes use of a machine having a rotary carrier 50 with a bore for receiving a tube blank and rotatably carrying three tools 52, 52 and 54 arranged such as to embrace the tube blank. The tools 52, 52 have smooth outer peripheral surfaces, while the tool 54 is a gear-like tool having teeth 40 on its surface. As the carrier 50 is driven to rotate around the tube blank by a suitable power, the teeth 40 on the gear-like tool 54 forcibly depress and plastically deform the wall of the tube blank thereby forming inward projections 3 on the inner peripheral surface of the tube blank. It will be seen that the pitch of the projections 3 in the direction of axis O—O' of the tube blank is determined by the angle at which the gear-like teeth is mounted. The configuration of the tooth 40 on the tool 54 is so selected that the portions of the projection 3 is rounded at corners thereof corresponding to the corners of the tooth 40.

The pitch of the dents on the outer surface of the tube blank corresponding to the projections 3 is equal to the circumferential pitch of the teeth 40 on the gear-like tool 54, while a radial height of the projection 3 can be adjusted by controlling the pressure at which the tool 54 is pressed onto the tube blank. If the tool 54 is driven in the direction perpendicular to the tube axis, the projections 3 are formed along independent annular rows. However, if the tube blank 1 is fed axially during the operation of the tool 54 as shown in FIG. 1, the projections, 3 are formed along spiral lines. The same effect can be obtained by feeding the carrier 50 in a spiral manner, although it is more practicaly to feed the tube in the axial direction while maintaining the carrier 50 stationary. Smooth surfaces are left between adjacent rows of the projections. The dents formed in the outer surface of the tube blank cannot be subjected to the fine machining which is to be conducted for the purpose of promotion of the boiling and condensation outside the tube, so that only the smooth areas between adjacent rows of dents are available as the effective area for promoting the heat transfer. In order to precisely conduct the required machining on the tube outer surface, it is necessary that the tube outer surface has areas parallel to the tube axis between adjacent rows of dents. It will be seen that, the portions of the tube inner surface under the areas parallel to the tube axis are naturally formed in parallel with the tube axis.

Figure 5A:
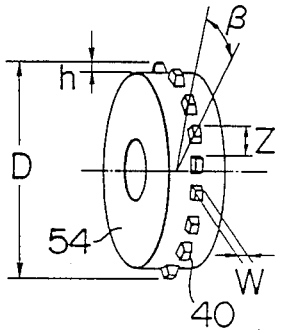

FIG. 5A schematically shows the gear-like tool used in the described method. It will be seen that the circumferential pitch z of the projection can be varied by varying the angle $\beta$ which is formed between the center of the tool 54 and the adjacent outer edges of adjacent teeth 40. The tooth height b should be selected to be greater than the depth of dent from the outer surface of the tube. In a practical example, the gear-like tool 54 has an outside diameter D of 33 to 35 mm, a teeth height h of 0.45 to 0.8 mm, angle 8 of 10° to 20° and a tooth width w of about 1 mm. Using this gear-like tool, it is possible to obtain a heat transfer tube having a projection height e of 0.45 to 6 mm and circumferential projection pitch z of 2.5 to 5 mm.

A change in the outside diameter D naturally requires a change in the angle $\beta$. The axial pitch of the projections can be varied within the range of, for example. 5 to 14 mm, by inclining the gear-like tool 54 at an angle of 5° to 20° with respect to the tube axis.

Although the embodiment described with reference to FIG. 5 has only one gear-like tool 54 such as to form the projections 3 along a single spiral curve, the invention does not exclude the use of a plurality of gear-like tools 54 such that the projections 3 are formed along a plurality of spiral curves simultaneously. The use of a plurality of gear-like tools 54 is effective in reducing the number of steps required for the formation of the projection rows, but this selection depends on the circumferential pitch of the projections and the axial pitch of the projection rows.

With the production method of the invention, it is possible to obtain a heat transfer tube having a plurality of projections 3 arranged in rows, each projection having a substantially circularly arched cross-sectional shape and a vertical section constituted by an arcuate protrusion when taken in a vertical section including the axis of the row of the projections.

In a particular example, the projection has an elliptic cross-sectional form having a longer diameter ranging between 2 and 5 mm and a shorter diameter ranging between 1.5 and 3 mm.

The rows of the projections may be formed such that independent conical projections having rounded ends are arranged to protrude from the major level of the tube inner surface or such that, in each row, the portions between adjacent projections are protruded from the major level of the tube inner surface.

Figure 6:
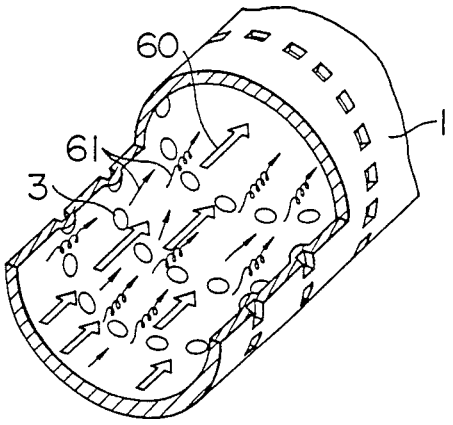
FIG. 6 is an illustration of the operation characteristics of the heat transfer tube in accordance with the invention.

FIG. 6 schematically illustrates the streamlines of a single-phase flow flowing in the tube without making any phase change. As shown in FIG. 6 the streamlines 60 in the radially central portion of the tube advance substantially straight in the direction of the tube axis, while streamlines 61 near the tube inner surface are deflected by the projections so that vertical eddy currents having axes in the direction of the tube axis are formed when these streamlines come out of the spaces between adjacent projections.

Figure 7:
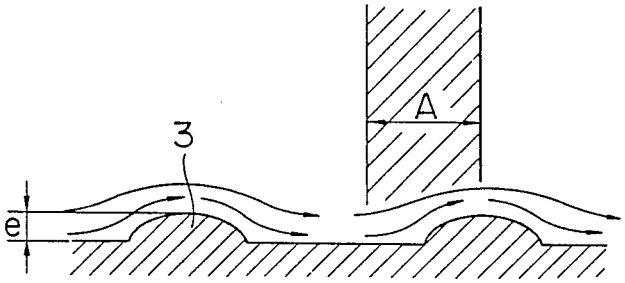
FIG. 7 is a sectional view of a heat transfer tube in accordance with the invention.
Figure 8:
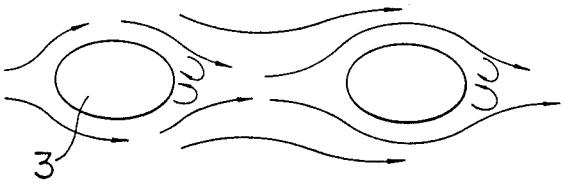
FIG. 8 is a front elevational view of the heat exchanger tube.

As will be seen from FIG. 7, since the projection 3 on the inner surface of the heat transfer tube of the invention has a smooth and gentle curvature when viewed in the vertical section, it does not cause any abrupt change in the directions of the streamlines. Therefore, the effect of the shearing stress due to coherence of the fluid acting on the tube surface is small and, hence, the pitching of the tube wall due to the shearing stress can be diminished advantageously. It is to be pointed out also that, since the cross-section of the projection also has smooth and gentle configurations, the abrupt deflection of the stream lines and generation of eddy currents due to exfoliation are suppressed to minimize the pitching caused by the action of the fluid.

In order to confirm the corrosion resistance of the heat transfer tube, an accelerated corrosion test was conducted under the condition shown in Table 1 and results as shown in Table 2 were obtained.

TABLE 1

| Corrosion Test Conditions | |
|---|---|
| Flow velocity | 2 m/sec |
| Water temperature | 40° C. |
| pH | 5.0 |
| $cl^-$ | 600 ppm |
| Testing period | 30 days |

TABLE 2

| Results of Corrosion Test | |
|---|---|
| Shape of projection | Corrosion rate (mm/year) |
| Two-dimensional (continuous projection) | 0.56 |
| Three-dimensional (angular projection) | 0.77 |
| Three-dimensional (rounded projection) | 0.54 |

From Table 2, it will be seen that rounded projections can retard the corrosion as compared with angular three-dimensional projections and can provide a corrosion rate which is as small as that observed with heat transfer tubes having two-dimensional projections which are known as exhibiting excellent corrosion resistance. Thus, the corrosion rate in the heat transfer tube with rounded three-dimensional projections shown in Table 2 is practically acceptable.

An explanation will be made hereinunder as to the performance of a heat transfer tube of the invention having rounded projections. An experiment was conducted by varying, among the parameters which affect the performance of the heat transfer tube, the projection height, circumferential pitch of projections and the axial pitch of the projection, in order to confirm the effect of the invention. The heat transfer tube subjected to the experiment has an inside diameter d which ranges between 14.7 mm and 15.8 mm.

Figure 9:
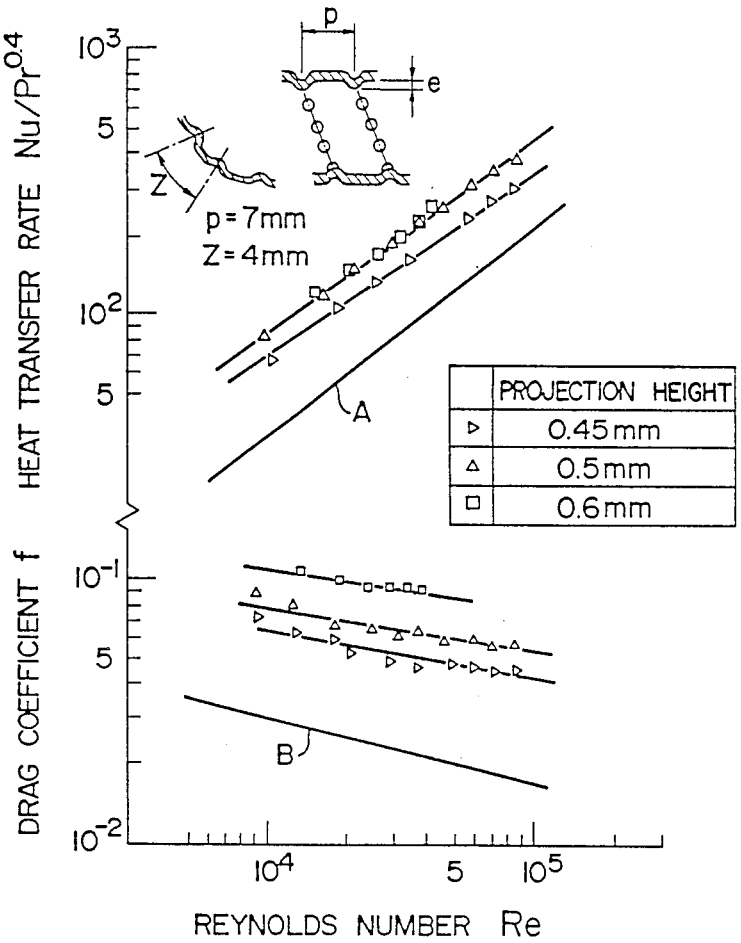
FIGS. 9 to 11 and FIGS. 14 to 17 are illustrations of experimental data as obtained with heat transfer tubes in accordance with the invention.

FIG. 9 shows the values of heat transfer rate and the pressure drop as obtained when the projection height e was 0.45 mm (marked at Δ), 0.5 mm (marked at Δ) and 0.6 mm (marked at □), while the axial pitch P and the circumferential pitch z were fixed at 7 mm and 4 mm, respectively. In FIG. 9, the axis of abscissa represents Reynold number and the drag coefficient f which represents the coefficient of flow resistance along the tube. As is well known, the reynolds number Re is given by the following formula:

$$R=u\cdot d/\nu$$

where, u represents the mean flow velocity of the fluid in the tube (m/s), d represents the inside diameter of the tube (mm), and $\nu$ represents the kinematic coefficient of viscosity of the fluid ($m^2/s$).

The axis of ordinate shows dimensionless heat transfer rate $Nu/Pr^{0.4}$ given by the following formula:

$$Nu/Pr^{0.4}=\alpha d/\lambda/Pr^{0.4}$$

where, $\alpha$ represents the heat transfer coefficient ($W/m^2$ K), $\lambda$ represents the heat conductivity of the fluid (W/m K) and Pr represents the Prandtl number of the fluid.

A comparison test was conducted using a comparison tube having a smooth inner surface which has not been subjected to any machining. This comparison tube showed heat transfer rate which well approximates the value given by $Nu=0.023Re^{0.8}Pr^{0.4}$ (shown by curve A) which is known as "Dittus-Boelter" formula. The comparison tube showed also a drag coefficient which well approximates the value given by $1/\sqrt{f}=2.0 \log (Re \sqrt{f})-0.8$ (curve B) which is known as "Prandl's equation". For the purpose of clarification of the drawing, the heat transfer rate and drag coefficient as obtained with the comparison tube are not shown in FIG. 9. The comparison tube had an inside diameter of 15.8 mm. It will be seen that the samples heat transfer tube of the invention having projection heights of 0.5 mm and 0.6 mm showed performance which is about twice as high as that of the comparison tube having smooth inner surface.

From FIG. 9, it will be seen also that the drag coefficient is increased at a rate greater than the rate of increase of the heat transfer coefficient as the projection height e is increased. Therefore, when the projection height e is increased above a predetermined threshold, the effect of the increase in the heat transfer rate is exceeded by the loss caused by the pressure drop. More specifically, in the case of the arrangement shown in FIG. 9, when the projection height is increased above 0.5 mm, the effect of promotion of heat transfer is reduced because of a large increase in the drag coefficient in contrast to a small increase in the heat transfer rate. From this fact, it is understood that the projection height is optimumly 0.5 mm, in the case of the heat transfer tube explained in connection with FIG. 9.

In order to confirm the above-explained advantageous effect of the invention, a reference is made to authoritative literature concerning the heat transfer rate and the drag coefficient.

An example of such literature is "Application of Rough Surfaces to Heat Exchanger Design" by R. L. Webb and E. R. G. Eckert, International Journal of Heat and Mass Transfer, Vol. 15, p 1647–1658, 1972. In this literature, there is given a concept concerning the heat transfer rate and the drag resistance as expressed by:

$$(St/Sto)/(f/fo)^{\frac{1}{3}}$$

where, the suffix 0 (zero) represents the values as obtained with tube having smooth inner surface.

Figure 10:
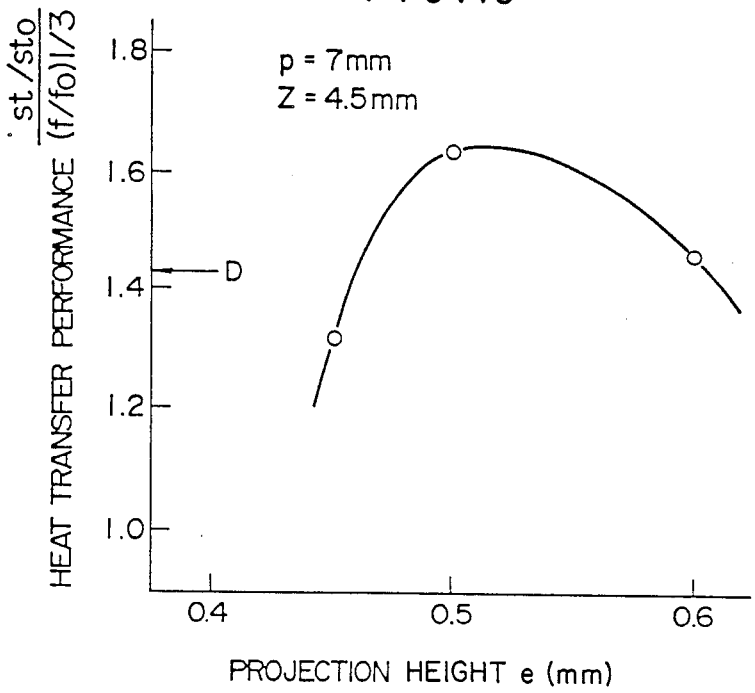

An evaluation was conducted by computing the ratios appearing in the above formula. In case of the tube having a smooth inner surface, the values of the ratios are "1". The value given by the formula is increased as the heat transfer performance is improved. The experimental data shown in FIG. 9 were obtained with the water flow velocity of 2.5 m/sec and Reynolds number Re of $3\times10^4$ which is calculated from the physical values corresponding to the water temperature in the refrigerator to which the heat transfer tube of the invention is applied. FIG. 10 shows the value of the above-mentioned formula in relation to the projection height.

From FIG. 10, it will be seen that the best performance is obtained when the projection height is around 0.5 mm, and the performance is progressively degraded as the projection height is increased beyond 0.5 mm and reduced below 0.5 mm. The optimum projection height is related to the boundary layer of the fluid adjacent the tube surface and can be considered as being almost constant, although there may be a small difference by factors such as, for example, the tube diameter. In FIG. 10, a symbol D pointing a value 1.43 represents the value of the formula mentioned above, calculated for a known heat transfer tube having two-dimensional ribs (e=0.3 mm, P=4 mm) of the type shown in U.S. Pat. No. 3,768,291. Thus, the performance of the heat transfer tube of the invention having three-dimensional projections exceeds the level of D=1.43 exhibited by the known heat transfer tube, when the projection height ranges between about 0.45 mm and 0.6 mm.

A description will be made hereinunder as to the result of an experiment which was conducted by using models in order to examine the influence of the circumferential pitch z of the projection on the heat transfer performance.

Figure 11:
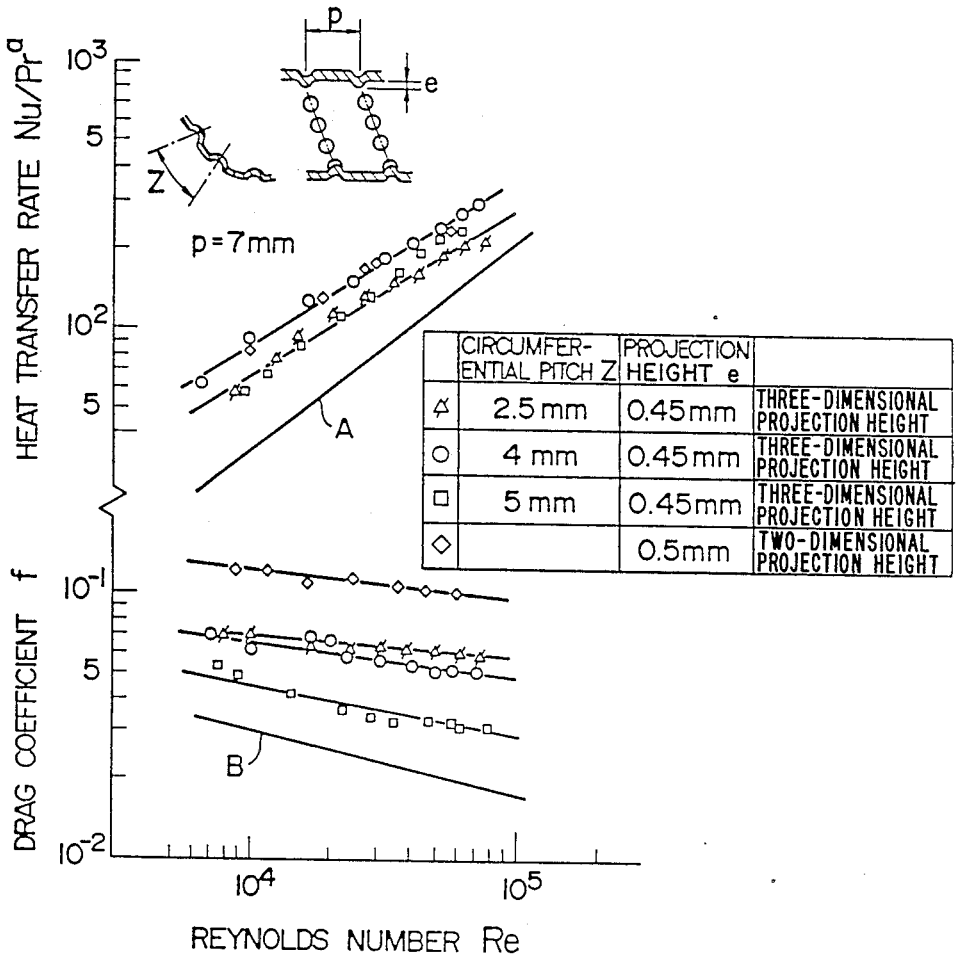

FIG. 11 shows the heat transfer rate and the drag coefficient as measured with three different values of the circumferential pitch z of the projections (Z=2.5 mm marked at Δ, z=4 mm marked at o and z=5 mm marked at □), while fixing the axial pitch of the projection and the projection height at 7 mm and 0.45 mm, respectively. From FIG. 10, it will be seen that a higher heat transfer rate is obtained when the circumferential pitch z is 4 mm than when the same is 2.5 mm. It will be seen also that the drag coefficient f is greater when the circumferential pitch z is 2.5 mm than when the same is 4 mm. There facts tell that a higher heat transfer performance is obtained when the circumferential pitch z is 4 mm than when the same is 2.5 mm.

Figure 12:
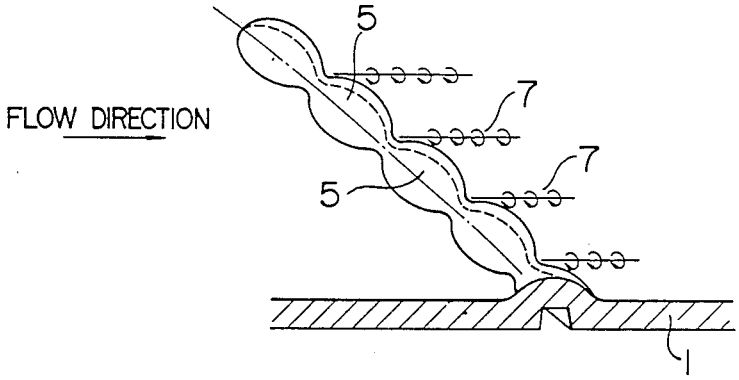
FIGS. 12 and 13 and FIGS. 18 and 19 are charts showing the relationship between the pitch of the projections and the heat transfer rate.
Figure 13:
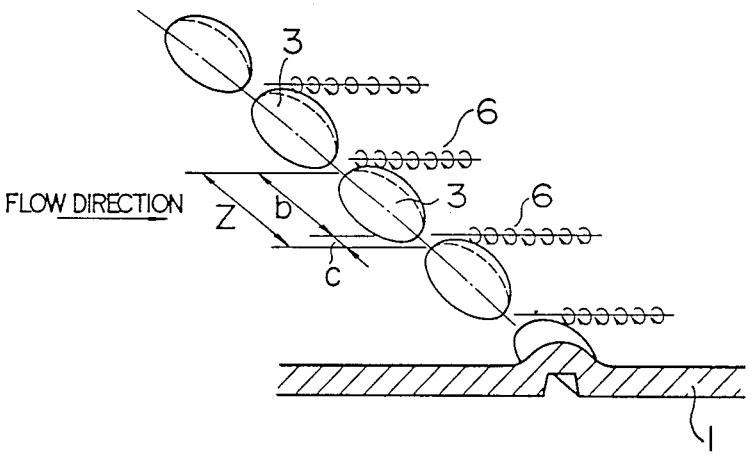

When the circumferential pitch z is 2.5 mm, adjacent projections 5 and 5 are substantially connected to each other so that there is no clearance C between adjacent projections, as will be seen from FIG. 12. Therefore, in this case, the size of vertical eddy currents 6 (see FIG. 13) produced by the stream lines coming out of the space between adjacent projections is small as represented by 7. Thus, the smaller circumferential pitch z makes the characteristics of the three-dimensional projections approach those of the two-dimensional projections, so that the heat transfer performance becomes closer to that of the heat transfer tube having two-dimensional projections. In FIG. 11, the curve plotted along the values marked by ◇ measured with a heat transfer tube having two-dimensional projections (p=7 mm, e=0.5 mm), together with the values measured with the heat transfer tube having three-dimensional projections. It will be seen that FIG. 11 also shows the same tendency, i.e., the fact that the smaller circumferential pitch z causes an increase in the pressure drop such as to approximate that provided by the two-dimensional projections.

When the circumferential pitch z is 4.5 mm, vertical eddy currents 6 having rotation axes parallel to the flowing direction are emitted from the clearances C between adjacent projections such as to enhance the heat transfer. In the case of two-dimensional projections, the streamlines are exfoliated when they pass over the two-dimensional projections and re-attach to the tube surface in the area downstream from the projections, and the promotion of the heat transfer owes to this re-attaching of the streamlines. In contrast, in case of the three-dimensional projections, the promotion of heat transfer is due to the generation of vertical eddy currents, so that the energy of the stream can be utilized more efficiently than in the case of the two-dimensional projections. In this case, the clearance c between adjacent projections was 1 mm, while the length b of each projection was 3 mm. When the clearance c is increased to a certain amount, the vertical eddy currents which are effective in the promotion of heat transfer are not produced so that the heat transfer promotion effect is not so high. Referring to FIG. 11, when the circumferential pitch z is 5 mm (see mark □), the increment of the heat transfer rate is smaller than that obtained when the pitch z is 4 mm. This suggests that the increase of the clearance c reduces the heat transfer rate.

Figure 14:
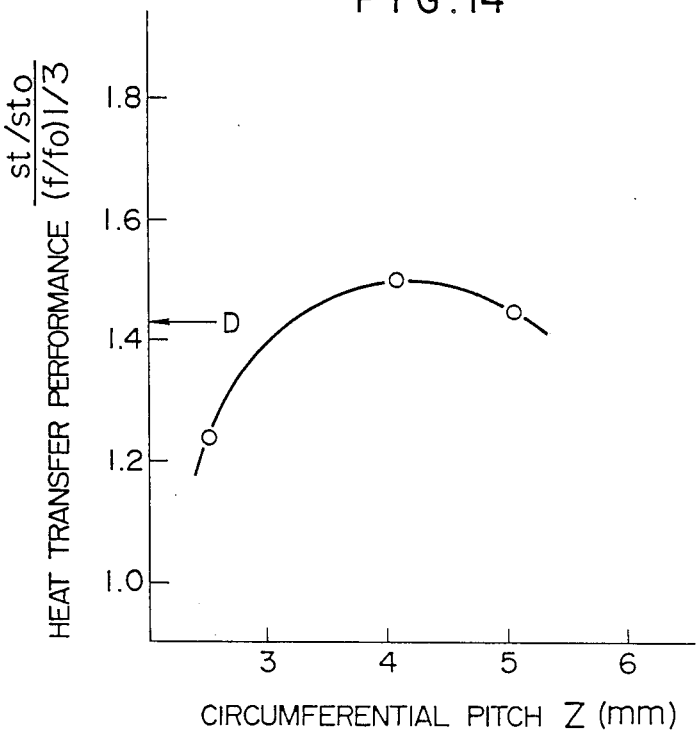

In this case also, the values obtained through the test were evaluated by making use of the aforementioned formula $St/Sto/(f/fo)^{\frac{1}{3}}$. The result is shown in FIG. 14 from which it will be seen that the highest heat transfer performance is obtained when the circumferential pitch z is 4 mm. The value denoted by D was obtained with the two dimensional rib (e=0.3 mm, p=4 mm). The value D suggests that the three dimensional projections provide higher heat transfer promotion effect. More specifically, the three dimensional projections provide the higher effect than that calculated from the values obtained through experiment with the heat transfer tube having two-dimensional ribs when the circumferential pitch z ranges between 3.5 mm and 5 mm and, therefore, this range is selected as being the preferred range of the circumferential pitch.

Figure 15:
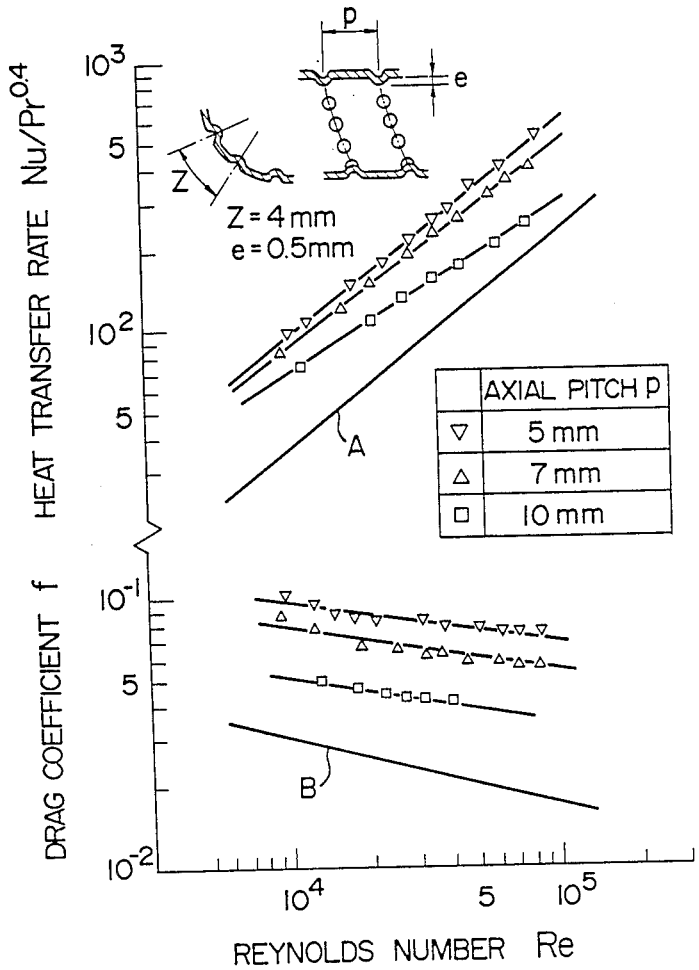
Figure 16:
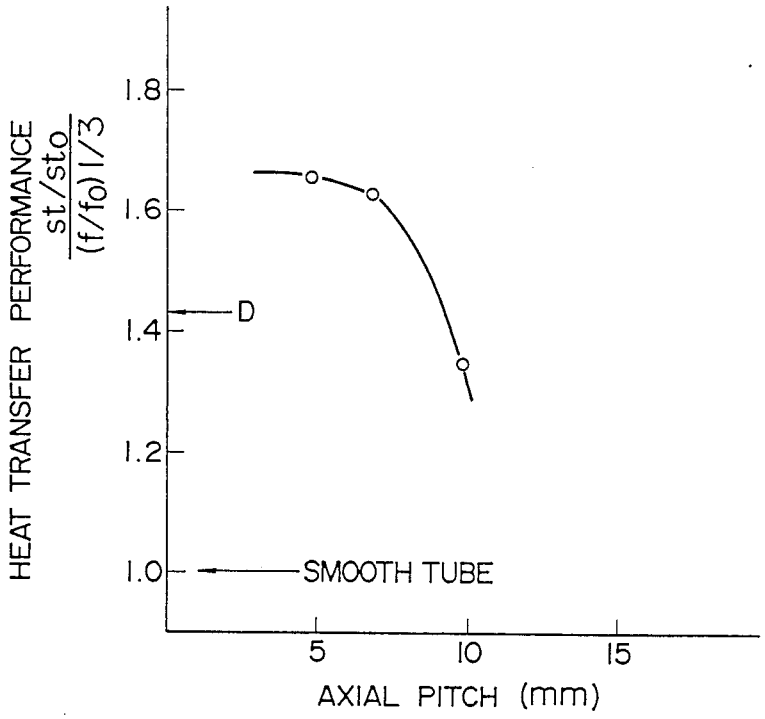
Figure 17A:
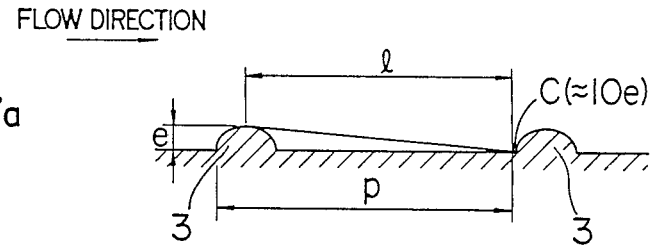
Figure 17B:
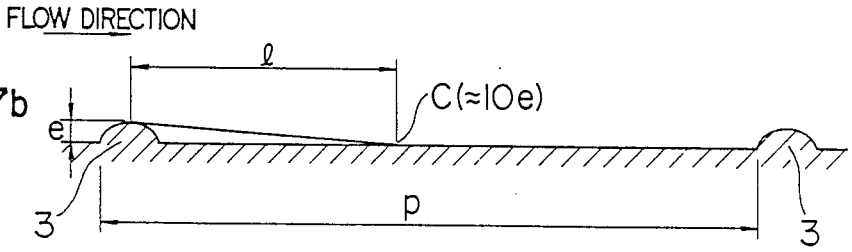

In order to examine the influence of the axial pitch, experiment was conducted by using three different values of axial pitch: namely, 5 mm, 7 mm and 10 mm, while fixing the rib height e and the circumferential pitch z at 0.5 mm and 4 mm, respectively. The result of this experiment is shown in FIG. 15. More specifically, FIG. 15 shows the heat transfer rate and the drag coefficient as obtained when the axial pitch is 5 mm (mark ▽), 7 mm (mark Δ) and 10 mm (mark □). It will be seen that both the heat transfer rate and the drag coefficient are increased as the axial pitch is increased. As in the preceding cases, the values obtained in this experiment were evaluated by using the formula $(St/Sto)/(f/fo)^{\frac{1}{3}}$, the result of which is shown in FIG. 16. From FIG. 16, it will be seen that the axial pitch of 5 mm and 7 mm provide substantially equal values of the ratio given by the above-mentioned formula, while the axial pitch of 10 mm provides a considerably smaller value. This is attributable to the following reason. Referring to FIGS. 17*a* and 17*b*, the promotion of heat transfer owes to the eddy currents generated by the three-dimensional projection 3, so that the high heat transfer performance is maintained when the next projection exists within the length in which the eddy currents are diffused and extinguished, as shown in FIG. 17*a*. The length in which the eddy currents are extinguished is about 10 times as large as the projection height, when the projection is two-dimensional. Namely, when the projection height is 0.5 mm, the length l is given as 0.5 mm×10=5 mm. Thus, the length l shown in FIG. 17*a* is estimated to be about 5 mm. Thus, the high performance is obtained when the axial pitch is between 5 and 7 mm. However, when the axial pitch is 10 mm, the pitch p is greater than the length l as shown in FIG. 17*b*. In this case, the eddy currents are extinguished before reaching the next projection so that there exists a large area where there is no eddy current, resulting in a smaller heat transfer promotion effect. In FIG. 16, D represents the value which is calculated in accordance with the aforementioned formula $(St/Sto)/(f/fo)^{\frac{1}{3}}$ from the values obtained through an experiment with the heat transfer tube having two-dimensional ribs. The axial pitch is preferably selected to range between 5 mm and 9 mm because this range provides both the heat transfer performance higher than the value D and easy fabrication of the heat transfer tube.

Preferred sizes of the projections have been discussed on the basis of experimental data, and it has been confirmed that the projection height, circumferential pitch of projection and, the axial pitch of the projection preferably range between 0.45 and 6 mm, 3.5 and 5 mm and 5 and 9 mm, respectively, in order to attain an appreciable effect in the improvement in the heat transfer performance.

Figure 18:
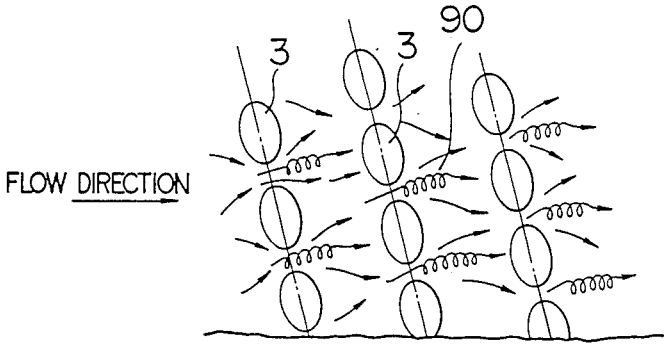
Figure 19:
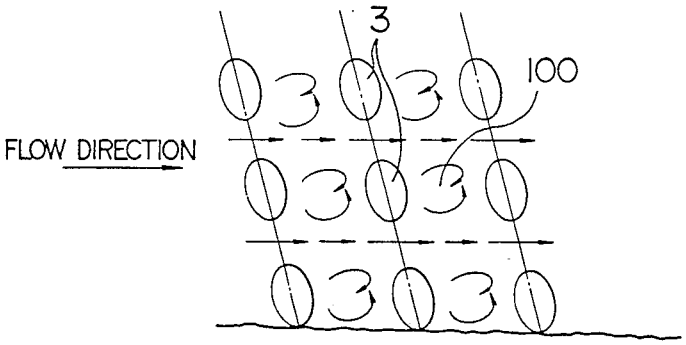

The pattern of streamlines past the rows of rounded projection varies depending on the arrangement of the projections. For instance, FIG. 18 shows the case where the projections 3 are arranged in a staggered manner. In this case, the heat transfer promotion effect is obtained by the fact that the streamlines 90 after passing the clearance between adjacent projections collide with the projection on the downstream side. However, when the projections 3 are arranged regularly in a lattice-like form as shown in FIG. 19, the vortex flow in the streamline 100 downstream from the projection 3 collides with the downstream projection before the energy of the vortex flow is diffused, so that the heat transfer promotion effect is suppressed. In addition, the streamlines which have passed through the clearance between adjacent projections are straight and parallel to the tube axis so that it does not contribute to the heat transfer promotion effect. For this reason, the projections are preferably arranged in a staggered manner.

In the case of conventional heat transfer tube with continuously corrugated inner surface, i.e., heat transfer tube with two-dimensional ribs, the pressure drop is considerably high although the heat transfer performance is excellent as shown in FIG. 11. The pressure drop is preferably small because the large pressure drop requires a greater pumping power for circulating the liquid. In case of the heat transfer tube of the invention, the increment in the heat transfer rate allows a reduction in the heat transfer area for a given thermal load, so that the pressure drop is decreased correspondingly such as to compensate for any reduction of the performance due to the increase in the drag coefficient.

Since the generation of turbulent flow in the area adjacent the tube wall is not so much affected by the tube diameter, the heat transfer tube of the invention having three-dimensional projections can be applied to tubes having inside diameters of about 10 to 25.4 mm.

Obviously, the heat transfer tube of the invention can have a suitable construction for promoting the heat transfer also on the outer surface thereof. The heat transfer promoting construction on the outer surface can be formed, for example, by the following procedure.

Figure 20:
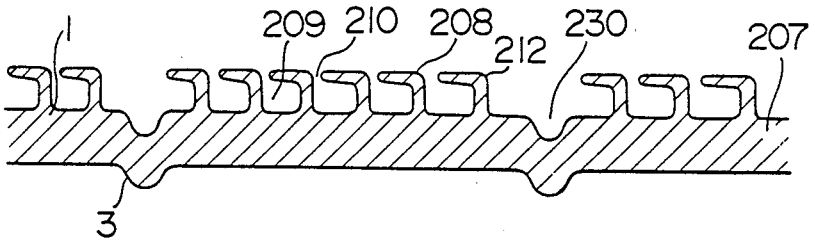
FIGS. 20 and 21 show an example of a heat exchanger tube to which the invention is applied.

As the first step, projections are formed on the inner surface of the tube blank by means of rolls which act on the outer side of the tube blank. The dents in the outer surface of the tube blank, which have been formed by the rolls for forming the projections on the inner surface of the tube blank, cannot be machined finely for the purpose of improving the heat transfer. It is, therefore, necessary to form the heat transfer promoting construction on the portions of the tube outer surface which are parallel to the tube axis and devoid of the dents. Therefore, in the next step of the process, porous heat transfer surfaces 208 which effectively promote the boiling heat transfer are formed in the smooth areas 207 of the tube outer surface devoid of the dents which have been formed during the forming of the projections on the inner surface, as shown in FIG. 20. In FIG. 20, a reference numeral 230 denote the dents formed when the projections on the inner surface were formed.

The fine machining on the outer surface of the tube block for the promotion of heat transfer may be conducted before the formation of the projections on the inner surfaces. In such a case, however, the heat transfer promoting construction formed by the fine machining tends to be collapsed by the rolls which act on the outer surface during the forming of the projections on the inner surface. Therefore, in the described case, the fine machining on the outer surface is conducted after the formation of the projections on the inner surface.

The fine machining on the outer surface of the tube blank is conducted, for example, in the following way. As the first step, shallow grooves of 0.1 to 0.2 mm are formed at an angle of about 45° to the tube axis by knurling. Then, the knurled surface is ploughed by a cutting tool substantially perpendicularly to the tube axis such as to form fins 212. The height and the pitch of the fins 212 are preferably about 1 mm and 0.4 to 0.6 mm, respectively. Consequently, rows of saw-teeth-shaped fins are formed on the smooth areas of the tube blank. Subsequently, the fins are made to laid down or collapsed such that adjacent fins get closer to each other by, for example, knurling, thereby forming a porous construction 208 constituted by fine cavities 209 which open to the outside through fine openings 210 between adjacent fins, as shown in FIG. 20. The thus formed tube has an outer surface as shown in FIG. 21.

In the use of this heat transfer tube, water is circulated through the tube while freon gas which is an organic medium having a low boiling point flows outside the tube. The tube is most probably used in a shell-and-tube type heat exchanger having a plurality of such tubes arranged in a barrel and used as, for example, an evaporator of a turbo-refrigerator. In such a case, the temperature of the water inside the tube is usually about 5° to 10° C. higher than the freon outside the tube. The flow of water in the tube has turbulency which is produced in the area near the tube inner surface due to the presence of the projections, so that the heat exchange between the tube inner surface and the water is made more effectively than in the case where the tube inner surface is smooth.

On the other hand, the freon flowing outside the tube is boiled to produce voids. These voids, once generated, are trapped in the cavities such as to form this freon films between the surfaces of the cavities and the voids. This thin freon film is easily evaporated such as to promote the heat transfer by the phenomenon called latent heat transportation.

Figure 21:
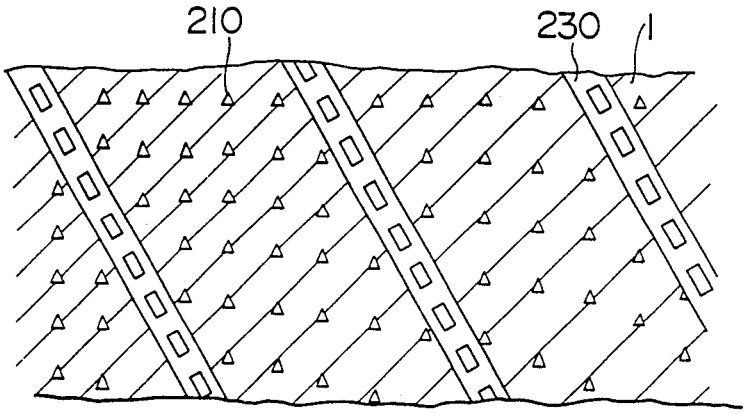
Figure 22:
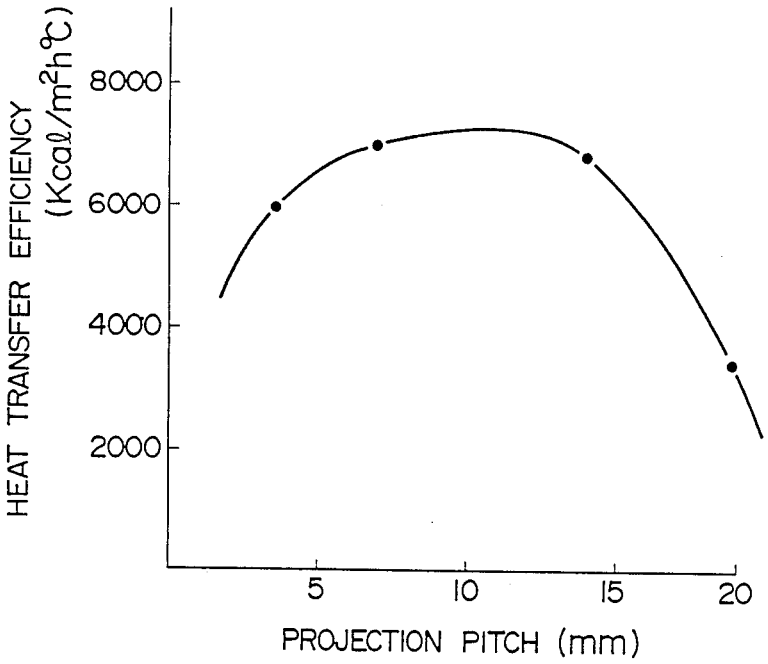
FIGS. 22 to 23 are illustration of the performance of the embodiment shown in FIG. 20.
Figure 23:
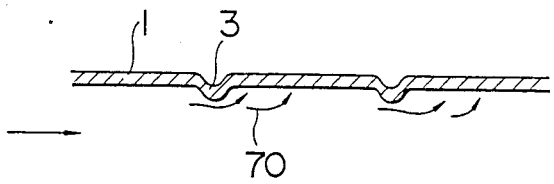

FIG. 22 shows the influence of the pitch p of the projections in the heat transfer tube shown in FIG. 21, on an assumption that the projection height is 0.3 mm. As will be seen from this Figure, there is a certain range of pitch p which provides high heat transfer efficiency. Namely, when the pitch p is large, the tube has a large smooth area on the outer surface thereof, so that the porous heat transfer promoting construction can be formed over a wide area. Consequently, the heat transfer between the outer tube surface and the medium flowing outside the tube is increased correspondingly.

On the other hand, an increased pitch p on the tube inner surface increases the area where the turbulency 70 of the streamline caused by the projection 3 does not affect the region near the inner tube surface. Consequently, the heat transfer rate is dratically decreased. In this case, the reduction in the heat transfer performance by the forced convection in the inner side of the tube exceeds the increment of the heat transfer performance obtained at the outer side of the tube. Consequently, the overall heat transfer performance of the tube as a whole is drastically decreased as the pitch p is increased beyond a certain value. On the other hand, the increase of the area on the tube inner surface on which the heat transfer is improved by the turbulency is saturated when the pitch p is reduced below a certain value, so that no substantial increase in the heat transfer efficiency by the forced convection inside the tube is attained. On the other hand, the smaller pitch p of the projections causes a drastic reduction in the area having the heat transfer promoting construction on the tube outer surface so that the boiling heat transfer on the outer tube surface is decreased drastically. Consequently, the overall heat transfer rate is decreased when the pitch p is decreased below a certain value.

For these reasons, high overall heat transfer rate of the heat transfer tube can be obtained only when the projection pitch p falls within a predetermined range. In the case of the arrangement shown in FIG. 22, the optimum range is between 5 mm and 15 mm.

Figure 24:
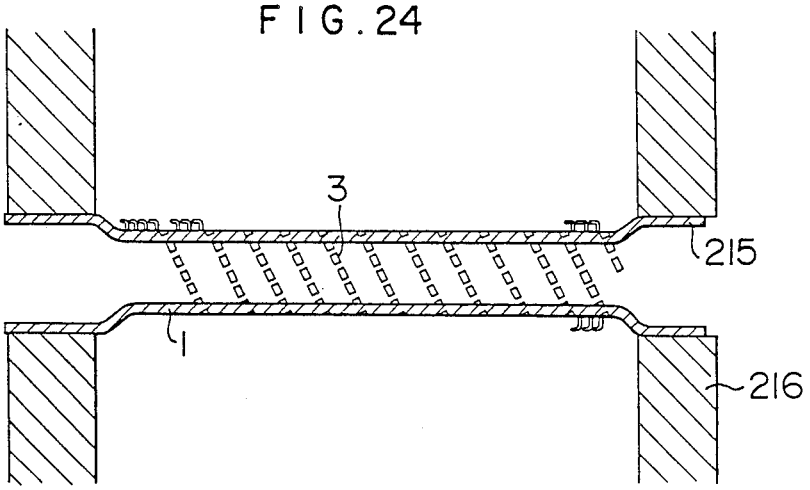
FIG. 24 is an illustration of an example of the use of the embodiment shown in FIG. 20.

The heat transfer tube of the invention can be used in a shell-and-tube type heat exchanger. In such a case, the heat-exchanger is produced by expanding the tube at its both ends 215 as shown in FIG. 24, forming the projections, inserting the tube into corresponding holes in end plates 216 and then fixing the tube to these end plates by expanding the tube ends. The conventional method of forming projections by means of the plug or by drawing cannot be conducted unless both ends of the tube are left straight. Therefore, when these conventional methods are used, the projections are first formed on the tube inner surface and then the projections on both ends of the tube are removed by cutting such as to smooth the surfaces at both ends of the tube, before the tube ends are expanded. Thus, the heat transfer tube of the invention is advantageous also in that it can reduce the number of steps in the assembly of a shell-and-tube type heat exchanger.

What is claimed is:

1. A method of producing a heat transfer tube for single-phase flow having one or more rows of projections plastically formed on the tube inner surface along a spiral curve or curves, each row including a multiplicity of discontinuous projections such that the portions of the tube inner surface between adjacent rows present surfaces parallel to the tube axis, said method comprising: depressing the outer surface of a tube blank by a tool having at least one row of discontinuous gear-like projections on its outer peripheral surface such as to form correspondingly radially inward projections on the inner surface of said tube blank, wherein said tool further includes at least one fixing tool for fixing said tube blank, said fixing tool and said gear-like tool rolling on the outer surface of said tube blank about a longitudinal axis of said tube blank to form at least one row of projections on the inner surface of said tube blank, and wherein said fixing tool and gear-like tool are arranged so as to coaxially surround said tube blank.

2. A method of producing a heat transfer tube for single phase flow according to claim 1, wherein said discontinuous projections on the outer peripheral surface of said gear-like tool have a height of 0.45 to 0.60 mm and are arranged at a circumferential pitch of approximately 1 mm and an axial pitch of 2.5 to 5 mm.

3. A method of producing a heat transfer tube for single phase flow according to claim 1, further comprising forming a porous surface on the outer surface of said tube blank by forming shallow grooves on said outer surface of said tube blank at an angle of about 45° to the tube axis by knurling, ploughing a knurled surface by a cutting tool substantially perpendicularly to the tube axis so as to form fins, and displacing said fins so as to form fine cavities.

4. A method of producing a heat transfer tube for single phase flow according to claim 1, wherein said fixing tool includes a flat outer peripheral surface, said flat fixing tool and gear-like tool are mounted on a rotary carrier.

* * * * *